US006548958B2

(12) United States Patent
Shimazu et al.

(10) Patent No.: US 6,548,958 B2
(45) Date of Patent: Apr. 15, 2003

(54) HOLLOW CATHODE LAMP

(75) Inventors: Yuji Shimazu, Hamamatsu (JP); Toshio Ito, Hamamatsu (JP); Jyunichi Imakama, Hamamatsu (JP)

(73) Assignee: Hamamatsu Photonics K.K., Hamamatsu (JP)

( * ) Notice: Subject to any disclaimer, the term of this patent is extended or adjusted under 35 U.S.C. 154(b) by 28 days.

(21) Appl. No.: 09/933,904

(22) Filed: Aug. 22, 2001

(65) Prior Publication Data

US 2002/0000775 A1 Jan. 3, 2002

Related U.S. Application Data

(63) Continuation-in-part of application No. PCT/JP00/01015, filed on Feb. 23, 2000.

(30) Foreign Application Priority Data

Feb. 23, 1999 (JP) ..... 11-044583

(51) Int. Cl.[7] ..... H01J 17/06
(52) U.S. Cl. ..... 313/618; 313/270
(58) Field of Search ..... 313/618, 446, 313/270, 346 R

(56) References Cited

U.S. PATENT DOCUMENTS 4,320,321 A 3/1982 Alexandrov et al. ..... 313/209

FOREIGN PATENT DOCUMENTS

JP 57-019941 2/1982
JP 57-107540 7/1982

OTHER PUBLICATIONS

XP–002192393, Database WPI, Section EI, Week 199641, Derwent Publications Ltd., London, GB; AN 1996–411182, Feb. 27, 1996.
XP–002192394, Database WPI, Section EI, Week 198422, Derwent Publications Ltd., London, GB, AN 1984–138307, Nov. 23, 1983.

*Primary Examiner*—Vip Patel
(74) *Attorney, Agent, or Firm*—Morgan, Lewis & Bockius LLP

(57) ABSTRACT

In a hollow cathode lamp comprising, in a bulb having a light exit port, a hollow cathode and an anode opposed to the light exit port, which comprises a tubular hood having a tubular shape, having one open end connected to the hollow cathode, having another open end opposed to the light exit port, and having an opening formed in a peripheral side face thereof, and an electron supply disposed at a position to front on the opening, discharge making use of thermoelectrons is implemented between the electron supply and the anode.

6 Claims, 6 Drawing Sheets

HOLLOW CATHODE LAMP

RELATED APPLICATION

This is a Continuation-In-Part application of International Patent application serial No. PCT/JP00/01015 filed on Feb. 23, 2000 now pending.

BACKGROUND OF THE INVENTION

1. Field of the Invention

The present invention relates to hollow cathode lamps used as light sources for atomic absorption spectrometry, atomic fluorescence spectrometry, and so on.

2. Related Background Art

In the atomic absorption spectrometry, it is necessary to use a light source for emitting an atomic spectral line of an analyte element itself, and hollow cathode lamps are known as such light sources. The hollow cathode lamps are configured to sputter the analyte element forming a hollow cathode by ion bombardment to scatter atoms of the analyte element in a discharge space and generate a spectral line through transfer of electron energy.

Meanwhile, as a problem arising during use of such hollow cathode lamps, there is the conventionally known phenomenon of self-absorption in which part of the spectral line imparts its energy to unexcited atoms of the element (unexcited element atoms) existing in the discharge space, thereby decreasing the intensity of the spectral line. If a rate of this self-absorption is high, optical output cannot be improved even with increase of an electric current supplied to the hollow cathode lamp.

Known techniques for solving the problem due to the self-absorption include, for example, the hollow cathode lamps described in U.S. Pat. Nos. 5,483,121 and 4,885,504. The hollow cathode lamps described in these publications both are provided with a thermoelectron supply (an auxiliary electrode for thermionic emission, electron emitter) for emitting thermoelectrons and are configured to excite the unexcited atoms by discharge with the thermionic emitter as a cathode. By exciting the unexcited atoms by the discharge with the thermionic emitter as a cathode in this way, it is feasible to prevent the absorption of the spectral line due to the unexcited atoms.

SUMMARY OF THE INVENTION

The hollow cathode lamps described in the above publications of U.S. Pat. Nos. 5,483,121 and 4,885,504, however, had the following problems. Namely, the element of the cathode is scattered by the aforementioned sputtering, this scattered element flies off with increase of the current supplied to the lamp over a certain level, the scattered element then scatters the spectral line, and the heavy scattering of the element results in deteriorating the effect of bringing the unexcited element into the excited state even by the discharge with the thermionic emitter as a cathode. This posed a problem that desired optical output was not gained even with increase in the working current of the lamp. There was another problem that the scattered element was heavily dispersed to adhere to the inner peripheral surface of a bulb of the lamp and thus become the cause of contamination of the bulb and it made preferred use thereafter difficult and made the lifetime of the lamp considerably shorter.

The present invention has been accomplished in view of the above circumstances and an object of the invention is to provide hollow cathode lamps that can provide high optical output and that is resistant to contamination on the internal surface of the bulb.

For accomplishing the above object, the present invention provides a hollow cathode lamp comprising, in a bulb having a light exit port, a hollow cathode and an anode opposed to the light exit port, the hollow cathode lamp comprising a tubular hood having a tubular shape, having one open end connected to the hollow cathode, having another open end opposed to the light exit port, and having an opening formed in a peripheral side face thereof; and an electron supply placed at a position to front on the opening, wherein discharge making use of thermoelectrons is implemented between the electron supply and the anode.

In the hollow cathode lamp according to the present invention, the cathode element scattered during the sputtering of the hollow cathode attaches onto the inner peripheral surface of the tubular hood and thus rarely contaminates the inner peripheral surface of the bulb. The tubular hood can prevent the situation of heavy dispersion of the scattered element in a wide area. This prevents the scattering of the spectral line emitted from the lamp, so as to improve the optical output. The opening is formed in the peripheral side face of the tubular hood and the electron supply for inducing the discharge making use of thermionic emission between the electron supply and the anode, in the hollow cathode and in the tubular hood is placed at the position to front on the opening. Then the discharge occurring through this opening between the electron supply and the anode can preliminarily excite the unexcited atoms existing in the hollow cathode and in the tubular hood, so as to prevent the self-absorption due to the unexcited atoms. At this time, since the tubular hood prevents the situation of heavy dispersion of the scattered element in a wide area, as described above, the foregoing discharge efficiently brings the unexcited element into the excited state.

The hollow cathode lamp according to the present invention is desirably configured to further comprise a cover covering the electron supply and the opening. When this configuration is adopted, it is feasible to prevent such a situation that the aforementioned cathode element scattered during the sputtering of the hollow cathode jumps out through the opening for supply of electrons, to deposit on the inner peripheral surface of the bulb.

A hollow cathode lamp according to another aspect of the present invention is a hollow cathode lamp comprising, in a bulb having a light exit port, a hollow cathode and an anode opposed to the light exit port, the hollow cathode lamp comprising a tubular hood having a tubular shape, having one open end connected to the hollow cathode, having another open end opposed to the light exit port, and having a slit formed in a peripheral side face thereof; and an electron supply placed at a position to front on the slit, wherein discharge making use of thermoelectrons is implemented between the electron supply and the anode.

In the hollow cathode lamp, the cathode element scattered during the sputtering of the hollow cathode attaches onto the inner peripheral surface of the tubular hood and thus rarely contaminates the inner peripheral surface of the bulb. The tubular hood can prevent the situation of heavy dispersion of the scattered element in a wide area. This prevents the scattering of the spectral line emitted from the lamp, so as to improve the optical output. The slit is formed in the peripheral side face of the tubular hood and the electron supply for inducing the discharge making use of the thermionic emission between the electron supply and the anode, in the hollow cathode and in the tubular hood is placed at the position to front on the slit. Then the discharge occurring through this slit between the electron supply and the anode can preliminarily excite the unexcited atoms existing in the hollow cathode, so as to prevent the self-absorption due to the unexcited atoms.

The hollow cathode lamp is desirably configured to further comprise a cover covering the electron supply and the slit. When this configuration is adopted, it is feasible to prevent such a situation that the aforementioned cathode element scattered during the sputtering of the hollow cathode jumps out through the slit for supply of electrons, to deposit on the inner peripheral surface of the bulb.

Further, in the hollow cathode lamps according to the present invention, desirably, the hollow cathode is a through cathode the interior of which is through, and the hollow cathode is located between the light exit port and the anode. When this configuration is adopted, because the anode is not located in the space between the hollow cathode and the light exit port, the existence of the anode does not impede traveling of light emitted from atoms when the atoms in the hollow cathode return into the ground state.

The present invention will become more fully understood from the detailed description given hereinbelow and the accompanying drawings which are given by way of illustration only, and thus are not to be considered as limiting the present invention.

BRIEF DESCRIPTION OF THE DRAWINGS

The present invention may be more readily described with reference to the accompanying drawings, in which.

DESCRIPTION OF THE PREFERRED EMBODIMENTS

The preferred embodiments of the hollow cathode lamps according to the present invention will be described below in detail with reference to the accompanying drawings. The same elements will be denoted by the same reference symbols and redundant description will be omitted.

[First Embodiment]

Figure 1:
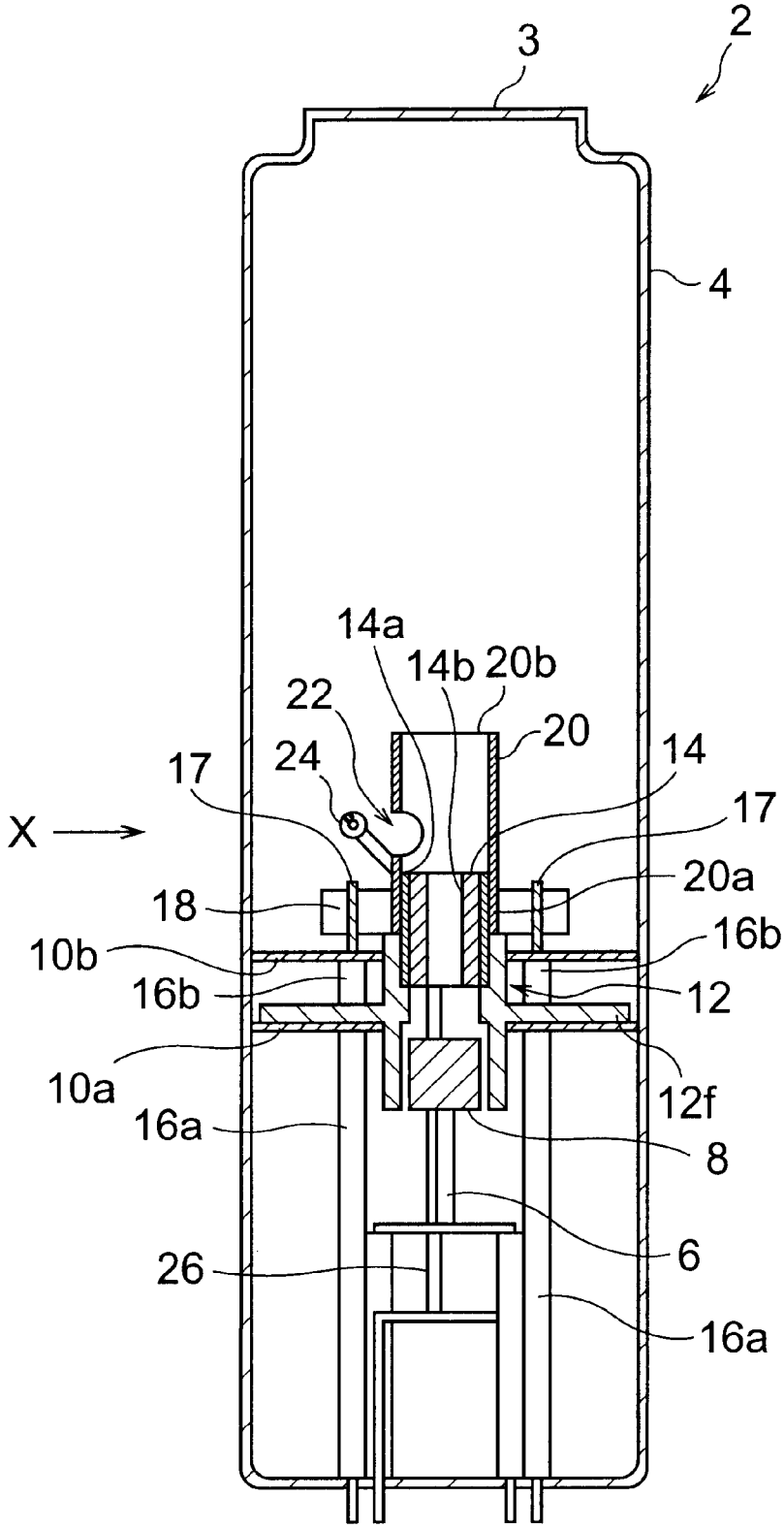
FIG. 1 is a cross-sectional view showing the first embodiment of the hollow cathode lamp according to the present invention.
Figure 2:
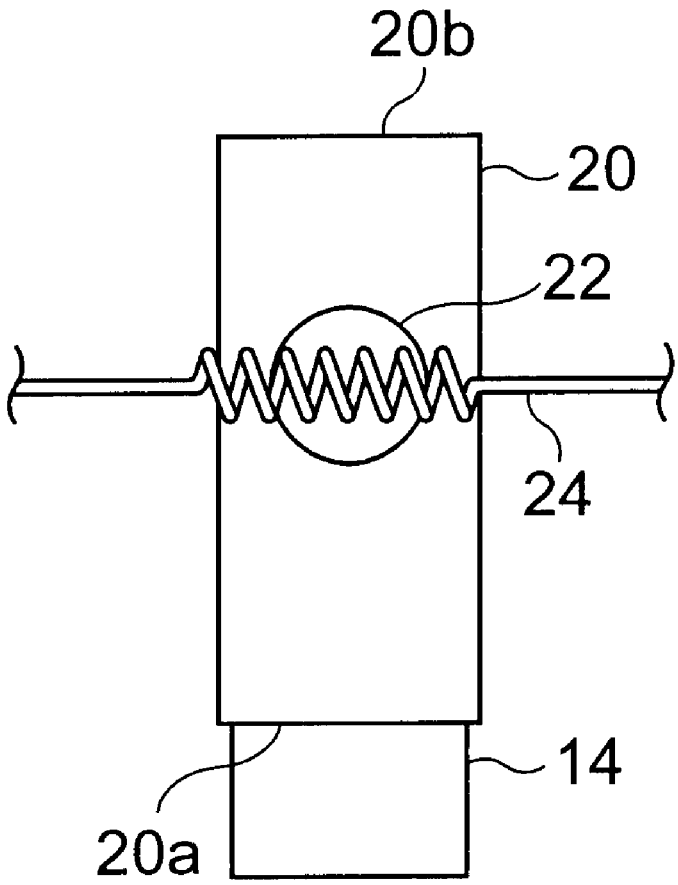
FIG. 2 is an enlarged view of the vicinity of the hollow cathode where the hollow cathode lamp shown in FIG. 1 is viewed from the direction X.

The structure of the hollow cathode lamp 2 of the present embodiment will be first described referring to FIG. 1 and FIG. 2. FIG. 1 is a cross-sectional view showing the hollow cathode lamp of the present embodiment and FIG. 2 is an enlarged view of the vicinity of the hollow cathode where the hollow cathode lamp shown in FIG. 1 is viewed from the direction X. The hollow cathode lamp 2 comprises, in a bulb 4 of silica glass having a light exit area (light exit port) 3 in the upper part thereof, a hollow cathode 14 the interior of which is through in the vertical direction in FIG. 1, and an anode 8 disposed below the hollow cathode 14. The bulb 4 is hermetically sealed and the interior thereof is filled with neon gas.

The anode 8 is supported by an insulator tube 6 of a ceramic material and is electrically connected to a lead wire passing through the interior of the insulator tube 6. On the other hand, the hollow cathode 14 is supported and fixed relative to the bulb 4 by an electrically insulating cathode support member 12 a flange portion 12*f* of which is mounted on a mica base 10*a*. Below the base 10*a* there are two insulator tubes 16*a* placed on the both sides of the anode 8 and, further, insulator tubes 16*b* are provided between the flange portion 12*f* of the cathode support member 12 and a base 10*b* disposed above the base 10*a*. Then lead wires 17 penetrating the interior of the insulator tubes 16*a* and the insulator tubes 16*b* project above the base 10*b*. The base 10*a* and the base 10*b* are of ring shape, in which inner peripheral portions thereof are in contact with the cathode support member 12 while outer peripheral portions thereof are in contact with the inner peripheral wall of the bulb 4, thereby preventing shaking of the insulator tubes 16*a* and the insulator tubes 16*b*.

The hollow cathode 14 is composed of a tubular outside cylinder 14*a* of stainless steel and an inside cylinder 14*b* of vanadium formed on the inner peripheral surface of the outside cylinder 14*a*. The material making the inside cylinder 14*b* of the hollow cathode 14 is not limited to vanadium, but can be variously changed according to the analyte element; for example, the material can be selenium, arsenic, or the like. The material making the outside cylinder 14*a* is not limited to stainless steel, either, and the outside cylinder 14*a* can be excluded depending upon the material making the inside cylinder 14*b*.

A tubular hood 20, which is the feature of the present embodiment, is mounted on the upper part of the hollow cathode 14 so as to be coaxial with the hollow cathode 14. More specifically, the hood 20 is mounted on the hollow cathode 14 so that the lower inner periphery of the hood 20 fits the upper outer periphery of the hollow cathode 14. The lower part of the hood 20 is fastened to the hollow cathode 14 by two hood securing plates 18 of metal. FIG. 1 shows only one located on the far side in the figure of the hollow cathode 14, out of the two hood securing plates 18 and in fact, the other hood securing plate 18 is also placed on the near side in the figure of the hollow cathode 14, the two hood securing plates 18 being bonded and fixed to each other by welding. The aforementioned lead wires 17 are interposed between the two hood securing plates 18, which establishes electric connection to the hollow cathode 14. A lower open end 20*a* of the hood 20 is in contact with the hollow cathode 14, while an upper open end 20*b* is opposed to the light exit area 3 of the bulb 4. The hood 20 is made of nickel, which has high thermal conductivity and which is resistant to sputtering. The material making the hood 20 is not limited to nickel, but may be stainless steel, aluminum, or the like.

Further, a circular opening 22 is formed in the peripheral side face of the hood 20. Located at a position to front on this opening 22 is a thermionic emitter (electron supply) 24 for inducing discharge making use of the thermionic emission between the cathode 24 and the anode 8 in the hood 20. Namely, the opening 22 is formed for inducing the discharge between the thermionic emitter 24 and the anode 8. The thermionic emitter 24 is supported by a support tube 26 through the interior of which a lead wire passes. The above described the structure of the hollow cathode lamp 2.

The action of the hollow cathode lamp 2 will be described below. First, a voltage is placed between the anode 8 and the hollow cathode 14 to induce discharge between the two electrodes. Then this discharge ionizes atoms of the neon gas filled in the bulb 4. Cations created by this ionization of gas are drawn by an electric field to bombard the inner peripheral surface of the inside cylinder 14*b* of the hollow cathode 14, whereupon kinetic energy of the cations sputters atoms of the cathode substance (vanadium) from the inner peripheral surface of the hollow cathode 14. This sputtered cathode element consists of single atoms in the ground state and others and thermally diffuses into the internal space of the hollow cathode 14. Then the scattered cathode element in the ground state under diffusion is excited by the discharge between the anode 8 and the hollow cathode 14 and the atoms thus excited again make transition into the ground state after a short period (approximately $10^{-8}$ second). On this occasion, the atoms emit monochromatic light (spectral line) intrinsic to vanadium, which is equivalent to energy of the transition. This light is outputted through the light exit area 3. Since the inner peripheral portions of the mica base 10*a* and base 10*b* are in contact with the cathode support member 12 while the outer peripheral portions thereof in contact with the inner peripheral wall of the bulb 4, it is feasible to prevent such a situation that a discharge path between the anode 8 and the hollow cathode 14 lies outside the hollow cathode 14.

In the present embodiment, since the hood 20 is mounted on the upper part of the hollow cathode 14 and since the scattered cathode element from the hollow cathode 14 is deposited on the inner peripheral surface of the hood 20, it is thus feasible to prevent the situation in which the scattered cathode element is deposited on and contaminates the inner peripheral surface of the bulb 4. The hood 20 can also prevent the situation of heavy dispersion of the scattered cathode element in a wide area, which can prevent the scattering of the spectral line outputted from the light exit area 3, thus improving the optical output. The density of the scattered cathode element becomes high in the hood 20. Furthermore, the hood 20 connected to the hollow cathode 14 is made of nickel with high thermal conductivity and also functions as a heat radiator for the hollow cathode 14. This lowers a temperature rise rate of the hollow cathode 14 with increase in the working current of the lamp 2 and it permit the working current of the lamp 2 to be set higher than before, thus improving the optical output. It is also feasible to prevent a situation in which the hollow cathode 14 is melted by heat before sputtered. Furthermore, since the anode 8 is not located in the space between the hollow cathode 14 and the light output surface 3, the existence of the anode 8 does not impede the spectral line traveling from the scattered cathode element in the hollow cathode 14 toward the light exit area 3.

In general, in the output process of light (spectral line) there is a possibility of bringing about the phenomenon of so-called self-absorption in which the energy of the spectral line is absorbed by the scattered cathode element in the unexcited state (the ground state). If the self-absorption should occur, the intensity of the spectral line would be weakened and the profile of the spectral line would become unsharp to degrade the analytic absorption sensitivity. In the present embodiment, however, the opening 22 is formed in the peripheral side face of the hood 20 and the thermionic emitter 24 is further placed at the position to front on this opening 22. When a voltage is applied through the lead wire in the support tube 26 to the thermionic emitter 24, the discharge making use of the thermionic emission is induced between the thermionic emitter 24 and the anode 8. Then this discharge can preliminarily bring the unexcited atoms into the excited state before collision with the spectral line and thus can prevent the self-absorption due to the unexcited atoms. At this time, the hood 20 prevents the situation of heavy dispersion of the scattered cathode element in a wide area as described above, so that the unexcited element can be efficiently brought into the excited state by the discharge making use of the thermionic emission.

Figure 3:
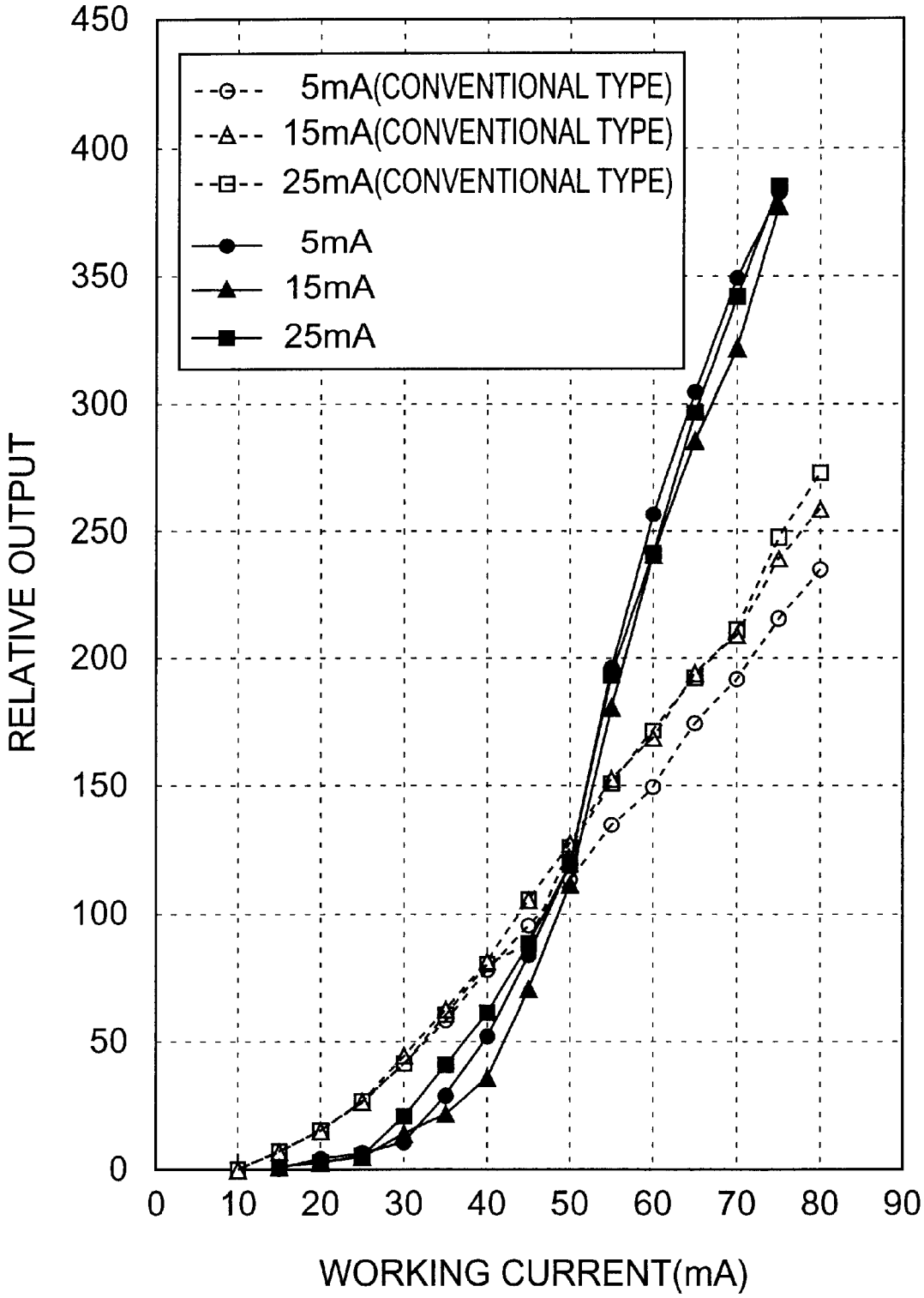
FIG. 3 is a graph showing the relation between working current and optical output of the hollow cathode lamp of the first embodiment.

FIG. 3 is a graph showing the relation between working current and optical output of the hollow cathode lamp 2 of the present embodiment, in which the abscissa represents the working current and the ordinate relative output. Also plotted on this graph is data concerning a hollow cathode lamp of the conventional type equipped with the thermoelectron emitting cathode but without the hood 20. The data of the hollow cathode lamp 2 of the present embodiment is indicated by solid lines connecting plots of black solid circles, triangles, and squares, while the data of the conventional type by dashed lines connecting plots of blank circles, triangles, and squares. The circles, triangles, and squares represent current values of 5 mA, 15 mA, and 25 mA, respectively, supplied to the thermionic emitter 24. It is seen from this graph that the lamp 2 of the present embodiment provides much higher optical output than the lamp of the conventional type, at all the current values supplied to the thermionic emitter 24. Particularly, when the working current of the lamp is raised to about 70 mA, the output of the lamp 2 of the present embodiment becomes 1.5 or more times the output of the lamp of the conventional type.

Figure 4:
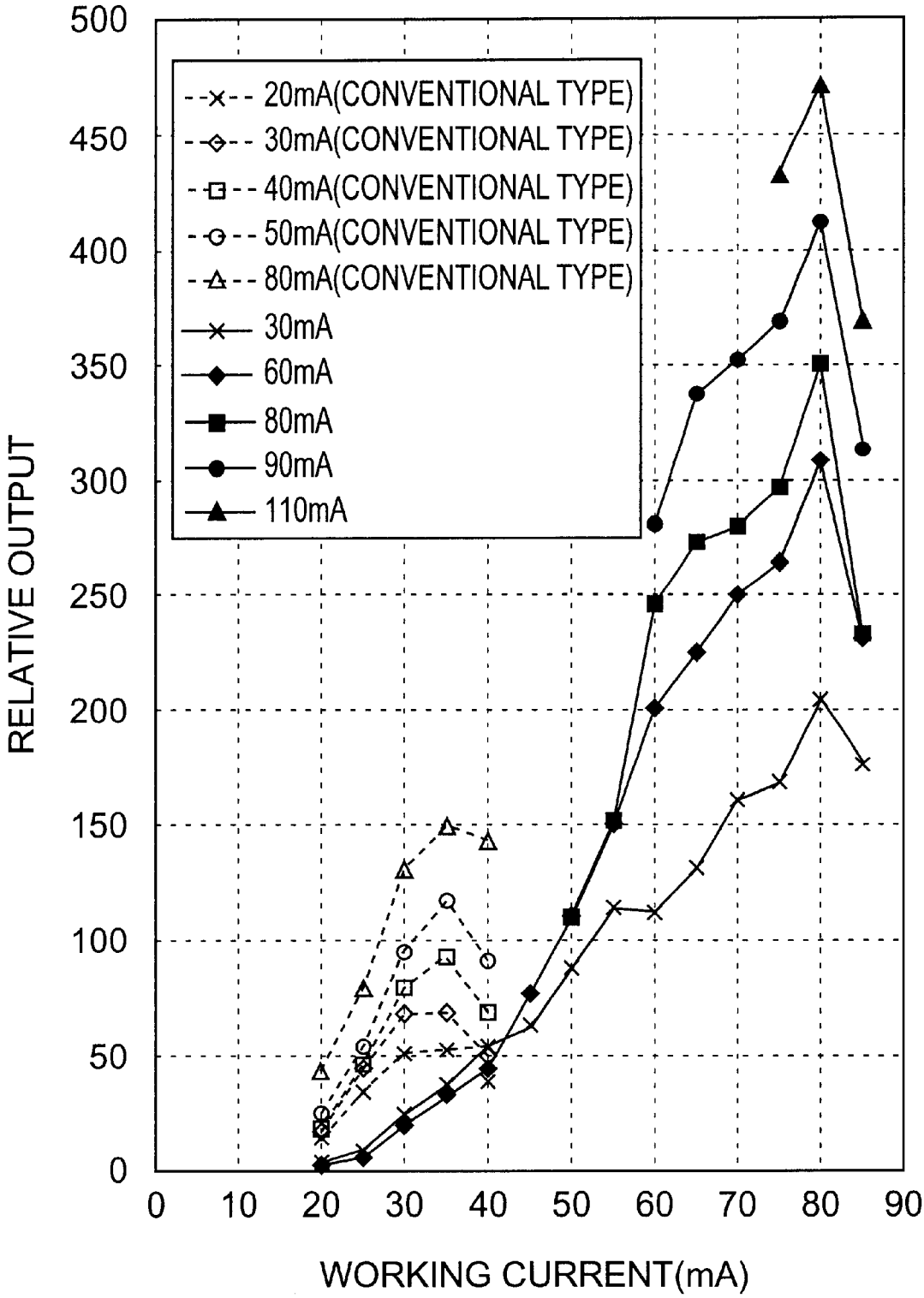
FIG. 4 is a graph showing the relation between working current and optical output where the hollow cathode is made of selenium in the hollow cathode lamp of the first embodiment.

FIG. 4 is a graph showing data in a configuration where in the hollow cathode lamp 2 of the present embodiment the material of the hollow cathode is selenium, which is easier to sputter than vanadium, instead of vanadium. As in FIG. 3, the data of the hollow cathode lamp 2 of the present embodiment is indicated by solid lines connecting respective plots and the data of the hollow cathode lamp of the conventional type by dashed lines connecting respective plots. Values of the current to the thermionic emitter 24 in the present embodiment were 30 mA, 60 mA, 80 mA, 90 mA, and 110 mA, and values of the current to the thermionic emitter 24 of the conventional type were 20 mA, 30 mA, 40 mA, 50 mA, and 80 mA.

As shown in FIG. 4, the optical output was considerably lowered when the working current of the lamp of the conventional type was increased up to about 40 mA. The reason is that the amount of the sputtered cathode element becomes larger with increase in the working current and the sputtered cathode element jumps out of the hollow cathode to be scattered in a wide area. If the lamp is further kept operating in this state, the scattered cathode element will become deposited on the bulb to contaminate the inner peripheral surface of the bulb, which will result in making the preferred use thereafter difficult and making the lifetime of the lamp extremely shorter. With the lamp of the present embodiment on the other hand, the optical output was kept high without decrease even at the working current increased to about 80 mA. Namely, the lamp of the present embodiment can provide the high output, which the conventional lamps were unable to achieve even with increase in the working current, so that the optical output can be gained in a wide range. It was also verified with the lamp of the present embodiment that the inner peripheral surface of the bulb was rarely contaminated even with increase in the working current up to 80 mA.

[Second Embodiment]

Figure 5:
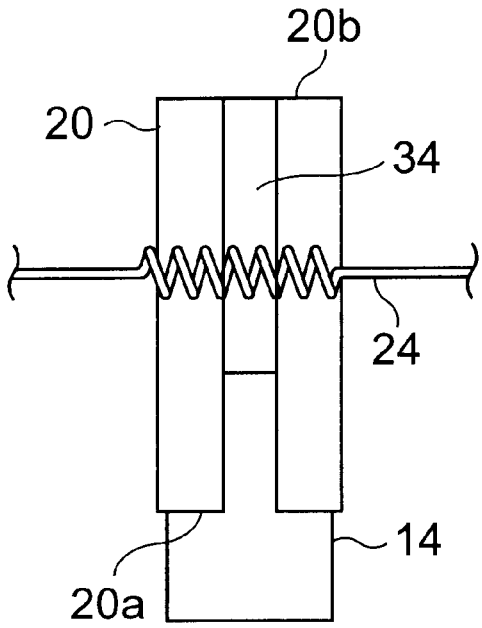
FIG. 5 is a view showing a characteristic part of the second embodiment of the hollow cathode lamp according to the present invention.

The second embodiment of the hollow cathode lamp according to the present invention will be described below. FIG. 5 is a view showing the characteristic part of the hollow cathode lamp of the present embodiment. The hollow cathode lamp of the present embodiment is different only in the structure of the hood 20 from the lamp 2 of the first embodiment. As shown in FIG. 5, the hood 20 of the present embodiment is provided with a slit 34 formed in the peripheral side face thereof, instead of the circular opening 22 (see FIG. 2) as in the first embodiment, in order to induce the discharge between the thermionic emitter 24 and the anode 8. The slit 34 extends from the upper open end 20*b* to the lower open end 20*a* of the hood 20. The thermionic emitter 24 is arranged perpendicular to the slit 34 at the position to front on this slit 34.

When this configuration is employed, the scattered cathode element from the hollow cathode 14 is also deposited on the inner peripheral surface of the hood 20, as in the first embodiment, and thus the configuration of the present embodiment can also prevent the situation in which the scattered cathode element is deposited to contaminate the inner peripheral surface of the bulb 4. The hood 20 can also prevent the situation of heavy dispersion of the scattered cathode element in a wide area, which can prevent the scattering of the spectral line outputted from the light exit area 3, thus improving the optical output. Further, the hood 20 also functions as a heat radiator for the hollow cathode 14, so as to lower the temperature rise rate of the hollow cathode 14 with increase in the working current of the lamp 2, and the working current of the lamp 2 can be set higher than before, so as to improve the optical output. The configuration of the present embodiment can also prevent the situation in which the hollow cathode 14 is melted by heat before sputtered.

Moreover, by the discharge making use of the thermionic emission, occurring through the slit 34 between the thermionic emitter 24 and the anode 8, the unexcited atoms existing in the hollow cathode 14 can be preliminarily brought into the excited state before collision with the spectral line, thereby preventing the self-absorption due to the unexcited atoms. At this time, as described above, the hood 20 prevents the situation of dispersion of the scattered cathode element in a wide area, and it is thus feasible to efficiently bring the unexcited element into the excited state by the discharge making use of the thermionic emission.

Figure 6:
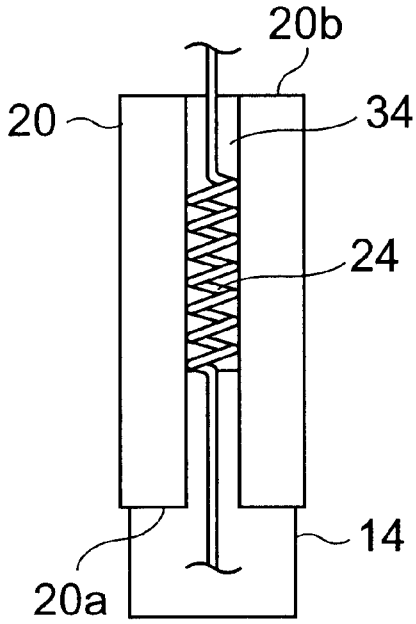
FIG. 6 is a view showing a modification example of the hollow cathode lamp of the second embodiment.

FIG. 6 is a view showing a modification example of the second embodiment. In this modification, the thermionic emitter 24 is not perpendicular to the slit 34 but parallel to the slit 34. When this configuration is employed, the discharge making use of thermoelectrons from the thermionic emitter 24 can be induced efficiently.

[Third Embodiment]

Figure 7:
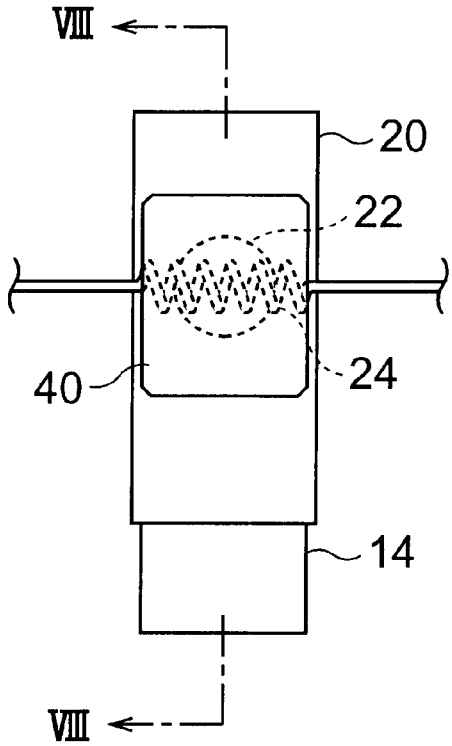
FIG. 7 is a view showing a characteristic part of the third embodiment of the hollow cathode lamp according to the present invention.
Figure 8:
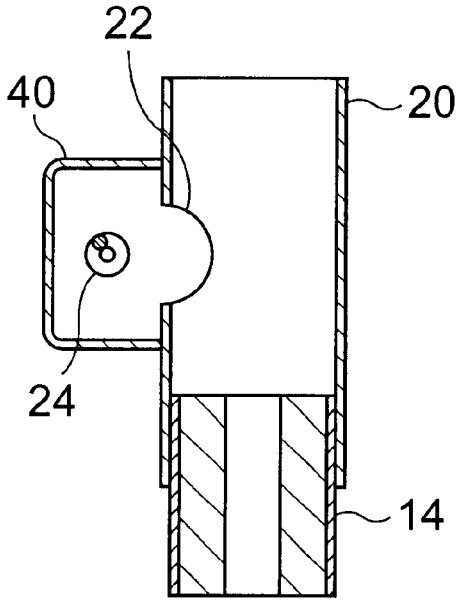
FIG. 8 is a cross-sectional view along VIII—VIII direction of the hollow cathode lamp shown in FIG. 7.

The hollow cathode lamp of the third embodiment will be described below referring to FIG. 7 and FIG. 8. FIG. 7 is a view showing the characteristic part of the hollow cathode lamp of the present embodiment and FIG. 8 a cross-sectional view along direction VIII—VIII of the lamp shown in FIG. 7. The hollow cathode lamp of the present embodiment is different in the structure of the hood 20 from the lamp 2 of the first embodiment. As shown in FIG. 7 and FIG. 8, the hood 20 is provided with a cover 40 covering the thermionic emitter 24 and the opening 22 formed in the hood 20.

The hollow cathode lamp of the present embodiment employing this configuration can prevent the situation in which the foregoing scattered cathode element from the hollow cathode 14 jumps out of the opening 22 for supply of electrons, to deposit on the inner peripheral surface of the bulb, whereby the lifetime of the lamp can be lengthened.

The hollow cathode lamp of the present embodiment is of the structure in which the cover 40 is mounted in the lamp of the first embodiment, and it can also be contemplated that the cover 40 is mounted in the hollow cathode lamp of the second embodiment as well. Namely, it is also preferable to cover the thermionic emitter 24 and the slit 34 by the cover 40.

The invention accomplished by the inventor was described above specifically based on the embodiments thereof, but the present invention is by no means intended to be limited to the above embodiments. For example, the hood is not limited to the cylinder of the circular cross section, but can be a rectangular tube or the like in accordance with the shape of the hollow cathode. The opening formed in the hood is not limited to the circular aperture, but can be adequately changed into the rectangular shape, the elliptical shape, or the like. Further, when the hollow cathode is comprised of the inner cylinder and the outer cylinder, it is also possible to employ such a configuration that the outer cylinder is extended toward the light exit area without provision of the separate hood, the extension part of this outer cylinder is regarded as a hood, and the opening for inducing the discharge between the electron supply and the anode is formed in the extension part.

In the hollow cathode lamps according to the present invention, as described above, the cathode element scattered during the sputtering of the hollow cathode is deposited on the inner peripheral surface of the tubular hood and thus the inner peripheral surface of the bulb is rarely contaminated. It is also feasible to prevent the situation of heavy dispersion of the scattered element in a wide area. This can prevent the scattering of the spectral line outputted from the lamp and thus can improve the optical output of the lamp.

The opening or the slit is formed in the peripheral side face of the tubular hood, and the electron supply for inducing the discharge making use of the thermionic emission between the electron supply and the anode, in the hollow cathode and in the tubular hood is disposed at the position to front on the opening or the slit. Then the discharge occurring through the opening or the slit between the electron supply and the anode can preliminarily bring the unexcited atoms existing in the hollow cathode and in the tubular hood, into the excited state, and thus can prevent the self-absorption due to the unexcited atoms. At this time, as described above, the tubular hood prevents the dispersion of the scattered element in a wide area, so that the unexcited element can be brought efficiently into the excited state by the discharge with the electron supply as a cathode, so as to improve the optical output further more.

From the invention thus described, it will be obvious that the embodiments of the invention may be varied in many ways. Such variations are not to be regarded as a departure from the spirit and scope of the invention, and all such modifications as would be obvious to one skilled in the art are intended for inclusion within the scope of the following claims.

What is claimed is:

1. A hollow cathode lamp comprising, in a bulb having a light exit port, a hollow cathode and an anode opposed to said light exit port, said hollow cathode lamp comprising:

a tubular hood having a tubular shape, having one open end connected to said hollow cathode, having another open end opposed to said light exit port, and having an opening formed in a peripheral side face thereof; and an electron supply disposed at a position to front on said opening, wherein discharge making use of thermoelectrons is implemented between said electron supply and said anode.

2. The hollow cathode lamp according to claim 1, further comprising a cover covering said electron supply and said opening.

3. The hollow cathode lamp according to claim 1, wherein said hollow cathode is a through cathode the interior of which is through, and said hollow cathode is located between said light exit port and said anode.

4. A hollow cathode lamp comprising, in a bulb having a light exit port, a hollow cathode and an anode opposed to said light exit port, said hollow cathode lamp comprising:

a tubular hood having a tubular shape, having one open end connected to said hollow cathode, having another open end opposed to said light exit port, and having a slit formed in a peripheral side face thereof; and an electron supply disposed at a position to front on said slit, wherein discharge making use of thermoelectrons is implemented between said electron supply and said anode.

5. The hollow cathode lamp according to claim 4, further comprising a cover covering said electron supply and said slit.

6. The hollow cathode lamp according to claim 4, wherein said hollow cathode is a through cathode the interior of which is through, and said hollow cathode is located between said light exit port and said anode.

* * * * *